US010495299B2

(12) United States Patent
Fortenbacher

(10) Patent No.: US 10,495,299 B2
(45) Date of Patent: Dec. 3, 2019

(54) SUPERHEATER

(71) Applicant: David Fortenbacher, Muskegon, MI (US)

(72) Inventor: David Fortenbacher, Muskegon, MI (US)

( * ) Notice: Subject to any disclaimer, the term of this patent is extended or adjusted under 35 U.S.C. 154(b) by 465 days.

(21) Appl. No.: 15/295,506

(22) Filed: Oct. 17, 2016

(65) Prior Publication Data

US 2018/0106474 A1 Apr. 19, 2018

(51) Int. Cl.

| | |
|---|---|
| ***F22G 1/16*** | (2006.01) |
| ***H05B 3/62*** | (2006.01) |
| ***H05B 3/48*** | (2006.01) |
| ***H05B 3/00*** | (2006.01) |
| ***F01K 7/22*** | (2006.01) |
| ***F22B 21/02*** | (2006.01) |

(52) U.S. Cl.

CPC ..... *F22G 1/165* (2013.01); *F01K 7/22* (2013.01); *F22B 21/02* (2013.01); *H05B 3/0014* (2013.01); *H05B 3/48* (2013.01); *H05B 3/62* (2013.01)

(58) Field of Classification Search

CPC ..... F22G 3/008
USPC ..... 392/386
See application file for complete search history.

(56) References Cited

U.S. PATENT DOCUMENTS 6,951,105 B1 * 10/2005 Smith ..... F01K 3/186 60/646
2009/0194525 A1 * 8/2009 Lee ..... H05B 3/145 219/553
2009/0268293 A1 * 10/2009 Duroux ..... B60R 1/0602 359/512
2010/0126985 A1 * 5/2010 Feng ..... H05B 3/145 219/553
2010/0213189 A1 * 8/2010 Keite-Telgenbuescher ..... B60R 1/0602 219/548
2011/0151254 A1 * 6/2011 Fugetsu ..... D06M 10/02 428/368
2013/0008394 A1 * 1/2013 Seltzer ..... F22G 1/06 122/481
2014/0034633 A1 * 2/2014 Heintz ..... H05B 3/565 219/525
2015/0366005 A1 * 12/2015 Janas ..... H05B 3/145 219/541

(Continued)

OTHER PUBLICATIONS

Zhu, J. et al., Improving the dispersion and integration of single-walled carbon nanotubes in epoxy composites through functionalization, 2003, Nano Letters, vol. 3, No. 8, 1107-1113. (Year: 2003).*

*Primary Examiner* — Ibrahime A Abraham
*Assistant Examiner* — Elizabeth M Sims
(74) *Attorney, Agent, or Firm* — James E. Shultz, Jr.

(57) ABSTRACT

A superheater may comprise a heating element that includes carbon nanotubes, wherein the heating element is encapsulated within a thermally insulating material on a first surface of the heating element and an inert material on a second surface and sides of the heating element, a positive electrical connection and a negative electrical connection, wherein the positive electrical connection and the negative electrical connection extend through the inert material, and wherein the positive electrical connection and the negative electrical connection are configured to connect the carbon nanotubes to an electric power source.

15 Claims, 2 Drawing Sheets

(56) References Cited

U.S. PATENT DOCUMENTS

| | | | | |
|---|---|---|---|---|
| 2016/0119977 | A1* | 4/2016 | Caldeira | H05B 3/145<br>219/539 |
| 2016/0185983 | A1* | 6/2016 | Lui | C09D 5/24<br>219/553 |
| 2016/0302260 | A1* | 10/2016 | Miller | B64D 15/12 |

* cited by examiner

SUPERHEATER

TECHNICAL FIELD

The present disclosure relates to superheaters. More particularly, the present disclosure relates to superheaters that include carbon nanotube heating elements.

BACKGROUND

In practice, power boilers may include superheaters (SH), (i.e., heat exchangers, in which the temperature of high pressure steam produced in an evaporator is raised above a saturation temperature). Superheated steam is then conducted to a high pressure steam turbine to produce steam power. Many boilers also comprise a reheater, in which the temperature of lower pressure steam released from the high pressure steam turbine is raised again, in order to produce more power by an intermediate pressure steam turbine. In the following, the term "superheater" may refer to either an actual superheater or a reheater. The term supercritical (SC) boiler refers to a boiler having a steam temperature of at least about 550° C., whereas, for ultra supercritical (USC) boilers, the steam temperature is at least about 600° C. The use of increased superheat and reheat temperatures improves the cycle, and thus, the plant efficiency.

Usually, a power boiler comprises a superheater system consisting of multiple in-series-connected superheater sections, which are located in different parts of the boiler. Superheaters are generally called convective superheaters (CSH), into which heat is mainly conducted by hot flue gas, or radiant superheaters (RSH), which dominantly absorb heat by radiation. Radiant superheaters are arranged at the top of the furnace of a boiler to be in direct visibility to the flames in the furnace. For SC and USC pulverized coal firing boilers, the duty of the RSH is substantially greater than that for a supercritical boiler. Thus, a series RSH arrangement is often used to obtain the required steam enthalpy. The metal tube temperature of an RSH depends on the local heat flux and on the temperature of the steam flowing in the tube. The metal temperature can be especially high at the bottom of a radiant SH, facing the flame zone.

Superheating of saturated steam is usually started in a CHS arranged in the flue gas channel downstream of the furnace. From the CHS, the steam usually goes to an RSH arranged at the upper portions of the furnace. The RSH may comprise pendant tube coils or hanging panels of tubes, or divisional tubewalls arranged parallel to the flue gas flow. Steam leaving the RSH usually goes to an attemperator, where water is sprayed onto the steam, to bring down the steam temperature to its desired value. From the attemperator, steam finally goes to a pendant superheater (PSH) arranged behind the nose of the furnace or in a horizontal pass immediately downstream of the furnace for further superheating the steam before it leaves to a high pressure (HP) turbine. Steam exiting the HP turbine may be conducted back to the furnace for being re-superheated to the desired temperature in a reheater (RH). Steam, after being reheated, flows to the intermediate pressure (IP) turbine for further expansion. The RH is usually arranged in the horizontal pass downstream of the PSH, but it may, as well as the PSH for final superheating, in some cases, also be arranged as a radiant superheater at the top portion of the furnace.

Due to high flame temperature in the furnace, the durability of superheaters may suffer from overheating. German Patent No. 1012614 discloses an arrangement in which the tubes of a superheater are protected from overheating by special shield tubes leading steam to a convective superheater. Great Britain Patent No. 855,114 discloses a boiler having superheater tubes, closest to the flame in the furnace, protected from radiation by reheater tubes surrounding the superheater tubes. It is also known from U.S. Pat. No. 3,101,698 to make a platen superheater behind a furnace nose, in which third and fourth passes are arranged partially in parallel flow (i.e., so that horizontal radiation is directed to tubes of a third pass, which are in flue gas flow upstream of the fourth pass, to prevent overheating of the hotter outlet tube sections).

The above-mentioned prior art solutions may adversely alter the heat duty among the superheating stages, and thus, lower the thermal efficiency of the boiler, or they address primarily convective dominant heat transfer. Therefore, there still exists a need for an improved superheater.

SUMMARY

A superheater may include a composite heating element that includes sidewall-functionalized carbon nanotubes. The superheater may further include a positive electrical connection and a negative electrical connection, wherein the positive electrical connection and the negative electrical connection are configured to connect the sidewall-functionalized carbon nanotubes to an electric power source.

In another embodiment, a superheater may include a composite heating element that includes carbon nanotubes. The superheater may further include a positive electrical connection and a negative electrical connection, wherein the positive electrical connection and the negative electrical connection are configured to connect the carbon nanotubes to an electric power source.

In a further embodiment, a superheater may include a heating element that includes carbon nanotubes. The superheater may further include a positive electrical connection and a negative electrical connection, wherein the positive electrical connection and the negative electrical connection are configured to connect the carbon nanotubes to an electric power source.

DETAIL DESCRIPTION

Figure 1:
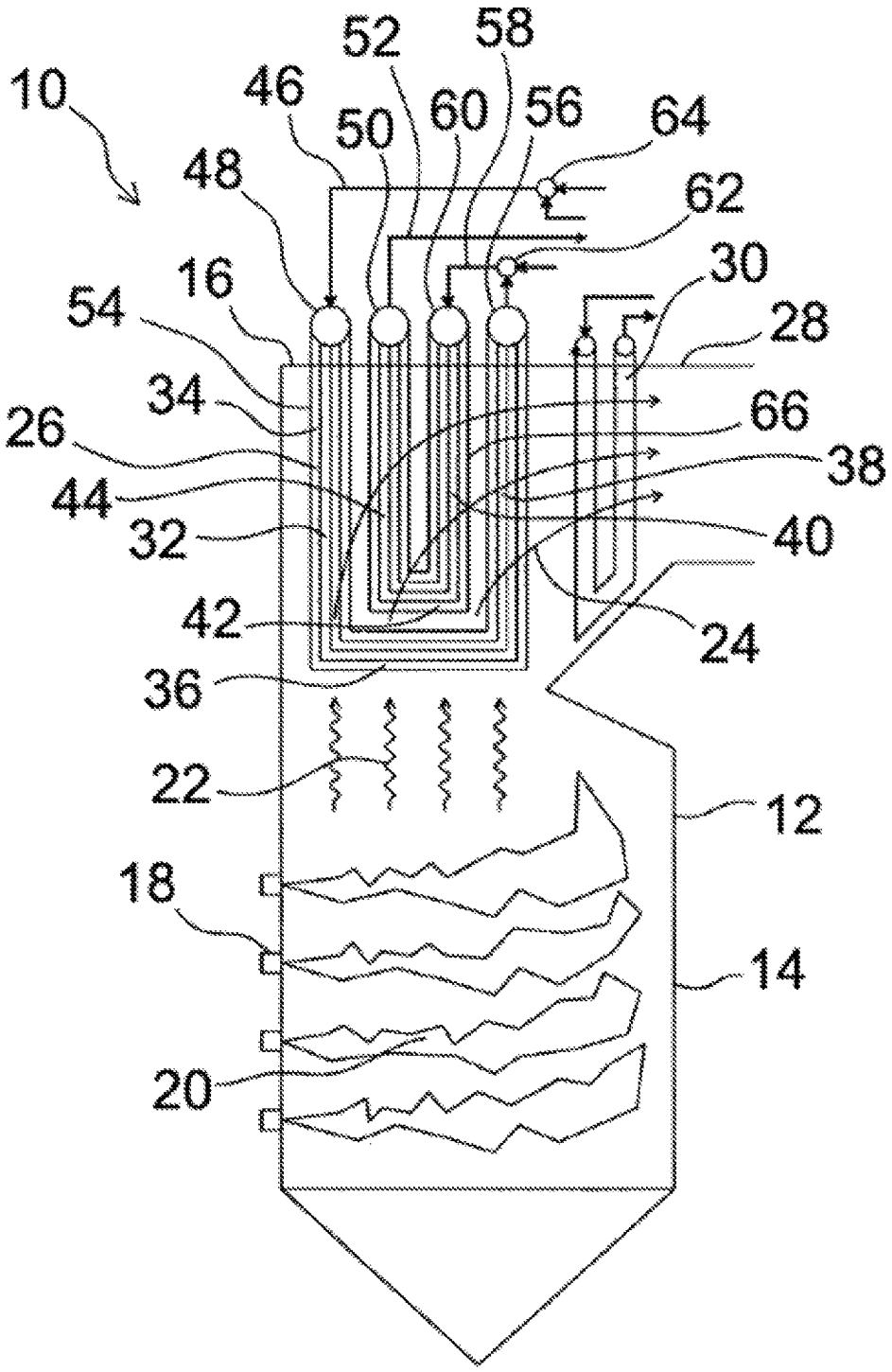
FIG. 1 depicts a superheater.

Superheaters are provided that may include carbon nanotubes. A superheater of the present disclosure may be a device used to convert saturated steam or wet steam into superheated steam or dry steam. Superheaters of the present disclosure may be used in steam engines or in processes, such as steam reforming. The superheaters of the present disclosure may be either radiant or convection. A superheater may vary in size from a few tens of feet to several hundred feet (a few metres to some hundred metres).

A nanoparticle composite may include a structure as disclosed, for example, in any one of U.S. Pat. No. 9,377,449, entitled Nanocomposite oil sensors for downhole hydrocarbon detection; U.S. Pat. No. 9,372,151, entitled Cross antennas for surface-enhanced infrared absorption (SERA) spectroscopy of chemical moieties; U.S. Pat. No. 9,358,730, entitled Dynamic strain hardening in polymer nanocomposites; U.S. Pat. No. 9,356,151, entitled Fabrication of graphene nanoribbons and nanowires using a meniscus as an etch mask; U.S. Pat. No. 9,340,894, entitled Anode battery materials and methods of making the same; U.S. Pat. No. 9,321,021, entitled Converting nanoparticles in oil to aqueous suspensions; U.S. Pat. No. 9,312,540, entitled Conformal coating on nanostructured electrode materials for three-dimensional applications; U.S. Pat. No. 9,312,078, entitled Patterned graphite oxide films and methods to make and use same; U.S. Pat. No. 9,290,665, entitled Coated fullerenes, compositions and dielectrics made therefrom; U.S. Pat. No. 9,283,511, entitled Composite materials for reversible CO.sub.2 capture; U.S. Pat. No. 9,260,570, entitled Compression induced stiffening and alignment of liquid crystal elastomers; U.S. Pat. No. 9,255,853, entitled Non-contact strain sensing of objects by use of single-walled carbon nanotubes; U.S. Pat. No. 9,249,023, entitled Liquid crystals from single-walled carbon nanotube polyelectrolytes and their use for making various materials; U.S. Pat. No. 9,228,009, entitled Multi-hierarchical self-assembly of a collagen mimetic peptide; U.S. Pat. No. 9,222,665, entitled Waste remediation; U.S. Pat. No. 9,202,952, entitled Plasmon induced hot carrier device, method for using the same, and method for manufacturing the same; U.S. Pat. No. 9,129,720, entitled Synthesis of uniform nanoparticle shapes with high selectivity; U.S. Pat. No. 9,106,342, entitled Device and method for modulating transmission of terahertz waves; U.S. Pat. No. 9,096,437, entitled Growth of graphene films from non-gaseous carbon sources; U.S. Pat. No. 9,095,876, entitled Immobilized carbon nanotubes on various surfaces; U.S. Pat. No. 9,068,109, entitled Nano-encapsulated triggered-release viscosity breaker; U.S. Pat. No. 9,067,791, entitled Embedded arrays of vertically aligned carbon nanotube carpets and methods for making them; U.S. Pat. No. 9,061,268, entitled Synthesis of ultrasmall metal oxide nanoparticles; U.S. Pat. No. 9,034,085, entitled Aliphatic amine based nanocarbons for the absorption of carbon dioxide; U.S. Pat. No. 9,032,731, entitled Cooling systems and hybrid A/C systems using an electromagnetic radiation-absorbing complex; U.S. Pat. No. 9,005,460, entitled Layer-by-layer removal of grapheme; U.S. Pat. No. 8,992,881, entitled Graphene nanoribbons prepared from carbon nanotubes via alkali metal exposure; U.S. Pat. No. 8,986,942, entitled Carbon nanotube based imaging agents; U.S. Pat. No. 8,958,362, entitled Method and system for wirelessly transmitting data; U.S. Pat. No. 8,956,440, entitled High-yield synthesis of gold nanorods with optical absorption at wavelengths greater than 1000 nm using hydroquinone; U.S. Pat. No. 8,916,606, entitled Therapeutic compositions and methods for targeted delivery of active agents; U.S. Pat. No. 8,906,984, entitled Synthesis of metal and metal oxide nanoparticle-embedded siloxane composites; U.S. Pat. No. 8,816,042, entitled Polyamide composites having flexible spacers; U.S. Pat. No. 8,815,231, entitled Systems and methods for magnetic guidance and patterning of materials; U.S. Pat. No. 8,809,979, entitled Functionalized carbon nanotube-polymer composites and interactions with radiation; U.S. Pat. No. 8,784,866, entitled Water-soluble carbon nanotube compositions for drug delivery and medicinal applications; U.S. Pat. No. 8,732,468, entitled Protecting hardware circuit design by secret sharing; U.S. Pat. No. 8,709,373, entitled Strongly bound carbon nanotube arrays directly grown on substrates and methods for production thereof; U.S. Pat. No. 8,703,090, entitled Methods for preparation of graphene nanoribbons from carbon nanotubes and compositions, thin films and devices derived therefrom; U.S. Pat. No. 8,679,442, entitled Fullerene compositions and methods for photochemical purification; U.S. Pat. No. 8,663,690, entitled Method for nanoencapsulation; U.S. Pat. No. 8,663,495, entitled Gelled nanotube-containing heat transfer medium; U.S. Pat. No. 8,636,830, entitled Aliphatic amine based nanocarbons for the absorption of carbon dioxide; U.S. Pat. No. 8,596,466, entitled Production of single-walled carbon nanotube grids; U.S. Pat. No. 8,591,854, entitled Methods for solubilizing and separating large fullerenes; U.S. Pat. No. 8,575,548, entitled Analyzing the transport of plasmonic particles through mineral formations; U.S. Pat. No. 8,562,935, entitled Amplification of carbon nanotubes via seeded-growth methods; U.S. Pat. No. 8,541,322, entitled Sidewall functionalization of carbon nanotubes with organosilanes for polymer composites; U.S. Pat. No. 8,540,959, entitled Bulk cutting of carbon nanotubes using electron beam irradiation; U.S. Pat. No. 8,460,428, entitled Single-crystalline metal nanorings and methods for synthesis thereof; U.S. Pat. No. 8,449,854, entitled Method for preparation of new superhard B—C—N material and material made therefrom; U.S. Pat. No. 8,440,467, entitled Electronic switching, memory, and sensor devices from a discontinuous graphene and/or graphite carbon layer on dielectric materials; U.S. Pat. No. 8,420,717, entitled Polyol functionalized water soluble carbon nanostructures; U.S. Pat. No. 8,398,950, entitled Condensation polymers having covalently bound carbon nanotubes; U.S. Pat. No. 8,395,901, entitled Vertically-stacked electronic devices having conductive carbon films; U.S. Pat. No. 8,394,664, entitled Electrical device fabrication from nanotube formations; U.S. Pat. No. 8,390,326, entitled Method for fabrication of a semiconductor element and structure thereof; U.S. Pat. No. 8,362,559, entitled Hybrid molecular electronic devices containing molecule-functionalized surfaces for switching, memory, and sensor applications and methods for fabricating same; U.S. Pat. No. 8,362,295, entitled Graphene compositions and methods for production thereof; U.S. Pat. No. 8,361,349, entitled Fabrication of light emitting film coated fullerenes and their application for in-vivo light emission; U.S. Pat. No. 8,337,809, entitled Charge-assembled capsules for phototherapy; U.S. Pat. No. 8,310,134, entitled Composition for energy generator, storage, and strain sensor and methods of use thereof; U.S. Pat. No. 8,269,501, entitled Methods for magnetic imaging of geological structures; U.S. Pat. No. 8,236,491, entitled Protein fragment complementation assay for thermophiles; U.S. Pat. No. 8,223,330, entitled Nanostructures and lithographic method for producing highly sensitive substrates for surface-enhanced spectroscopy; U.S. Pat. No. 8,217,137, entitled Fullerene-based amino acids; U.S. Pat. No. 8,201,517, entitled Method for low temperature growth of inorganic materials from solution using catalyzed growth and re-growth; U.S. Pat. No. 8,187,703, entitled Fiber-reinforced polymer composites containing functionalized carbon nanotubes; U.S. Pat. No. 8,183,180, entitled Graphene compositions and drilling fluids derived therefrom; U.S. Pat. No. 8,178,202, entitled Non-concentric nano shells with offset core in relation to shell and method of using the same; U.S. Pat. No. 8,158,203, entitled Methods of attaching or grafting carbon nanotubes to silicon surfaces and composite structures derived therefrom; U.S. Pat. No. 8,128,901, entitled Facile purification of carbon nanotubes with liquid bromine at room temperature; U.S. Pat. No. 8,124,503, entitled Carbon nanotube diameter selection by pretreatment of metal catalysts on surfaces; U.S. Pat. No. 8,106,430, entitled Preparation of thin film transistors (TFTs) or radio frequency identification (RFID) tags or other printable electronics using ink-jet printer and carbon nanotube inks; U.S. Pat. No. 8,097,141, entitled Flow dielectrophoretic separation of single wall carbon nanotubes; U.S. Pat. No. 8,092,774, entitled Nanotube-amino acids and methods for preparing same; U.S. Pat. No. 8,089,628, entitled Pulsed-multiline excitation for color-blind fluorescence detection; U.S. Pat. No. 8,080,199, entitled Interaction of microwaves with carbon nanotubes to facilitate modification; U.S. Pat. No. 8,062,748, entitled Methods for preparing carbon nanotube/polymer composites using free radical precursors; U.S. Pat. No. 8,062,702, entitled Coated fullerenes, composites and dielectrics made therefrom; U.S. Pat. No. 8,058,613, entitled Micromechanical devices for materials characterization; U.S. Pat. No. 8,045,152, entitled All optical nanoscale sensor; U.S. Pat. No. 8,007,829, entitled Method to fabricate inhomogeneous particles; U.S. Pat. No. 8,003,215, entitled Fluorinated nanodiamond as a precursor for solid substrate surface coating using wet chemistry; U.S. Pat. No. 7,998,271, entitled Solvents and new method for the synthesis of CdSe semiconductor nanocrystals; U.S. Pat. No. 7,976,816, entitled Method for functionalizating carbon naontubes utilizing peroxides; U.S. Pat. No. 7,973,559, entitled Method for fabrication of a semiconductor element and structure thereof; U.S. Pat. No. 7,959,779, entitled Macroscopically manipulable nanoscale devices made from nanotube assemblies; U.S. Pat. No. 7,940,043, entitled NMR method of detecting precipitants in a hydrocarbon stream; U.S. Pat. No. 7,939,136, entitled Method for forming composites of sub-arrays of fullerene nanotubes; U.S. Pat. No. 7,939,047, entitled Bulk separation of carbon nanotubes by bandgap; U.S. Pat. No. 7,938,991, entitled Polymer/carbon-nanotube interpenetrating networks and process for making same; U.S. Pat. No. 7,938,969, entitled Magnetic purification of a sample; U.S. Pat. No. 7,893,513, entitled Nanoparticle/nanotube-based nanoelectronic devices and chemically-directed assembly thereof; U.S. Pat. No. 7,887,774, entitled Methods for selective functionalization and separation of carbon nanotubes; U.S. Pat. No. 7,879,940, entitled Polymerization initiated at sidewalls of carbon nanotubes; U.S. Pat. No. 7,858,186, entitled Fluorinated nanodiamond as a precursor for solid substrate surface coating using wet chemistry; U.S. Pat. No. 7,838,077, entitled Functionalized, hydrogen-passivated silicon surfaces; U.S. Pat. No. 7,829,119, entitled Method to fabricate microcapsules from polymers and charged nanoparticles; U.S. Pat. No. 7,825,064, entitled Supported catalysts using nanoparticles as the support material; U.S. Pat. No. 7,821,079, entitled Preparation of thin film transistors (TFTs) or radio frequency identification (RFID) tags or other printable electronics using ink-jet printer and carbon nanotube inks; U.S. Pat. No. 7,820,130, entitled Functionalization of nanodiamond powder through fluorination and subsequent derivatization reactions; U.S. Pat. No. 7,790,066, entitled Nanorice particles: hybrid plasmonic nano structures; U.S. Pat. No. 7,758,841, entitled Reductive functionalization of carbon nanotubes; U.S. Pat. No. 7,744,844, entitled Functionalized carbon nanotube-polymer composites and interactions with radiation; U.S. Pat. No. 7,740,826, entitled Method for functionalizing carbon nanotubes utilizing peroxides; U.S. Pat. No. 7,730,547, entitled Smart materials: strain sensing and stress determination by means of nanotube sensing systems, composites, and devices; U.S. Pat. No. 7,727,504, entitled Fibers comprised of epitaxially grown single-wall carbon nanotubes, and a method for added catalyst and continuous growth at the tip; U.S. Pat. No. 7,718,550, entitled Method for low temperature growth of inorganic materials from solution using catalyzed growth and re-growth; U.S. Pat. No. 7,692,218, entitled Method for creating a functional interface between a nanoparticle, nanotube or nanowire, and a biological molecule or system; U.S. Pat. No. 7,682,527, entitled Fabrication of light emitting film coated fullerenes and their application for in-vivo light emission; U.S. Pat. No. 7,682,523, entitled Fluorescent security ink using carbon nanotubes; U.S. Pat. No. 7,670,583, entitled Multi-step purification of single-wall carbon nanotubes; U.S. Pat. No. 7,655,302, entitled Continuous fiber of fullerene nanotubes; U.S. Pat. No. 7,632,569, entitled Array of fullerene nanotubes; U.S. Pat. No. 7,632,481, entitled Sidewall functionalization of nanotubes with hydroxyl terminated moieties; U.S. Pat. No. 7,601,421, entitled Fabrication of carbon nanotube reinforced epoxy polymer composites using functionalized carbon nanotubes; U.S. Pat. No. 7,585,420, entitled Carbon nanotube substrates and catalyzed hot stamp for polishing and patterning the substrates; U.S. Pat. No. 7,578,941, entitled Length-based liquid-liquid extraction of carbon nanotubes using a phase transfer catalyst; U.S. Pat. No. 7,572,426, entitled Selective functionalization of carbon nanotubes; U.S. Pat. No. 7,527,831, entitled Method of making a molecule-surface interface; U.S. Pat. No. 7,511,811, entitled Pulsed-multiline excitation for color-blind fluorescence detection; U.S. Pat. No. 7,510,695, entitled Method for forming a patterned array of fullerene nanotubes; U.S. Pat. No. 7,494,639, entitled Purification of carbon nanotubes based on the chemistry of fenton's reagent; U.S. Pat. No. 7,481,989, entitled Method for cutting fullerene nanotubes; U.S. Pat. No. 7,470,417, entitled Ozonation of carbon nanotubes in fluorocarbons; U.S. Pat. No. 7,452,519, entitled Sidewall functionalization of single-wall carbon nanotubes through C—N bond forming substitutions of fluoronanotubes; U.S. Pat. No. 7,419,651, entitled Method for producing self-assembled objects comprising fullerene nanotubes and compositions thereof; U.S. Pat. No. 7,419,624, entitled Methods for producing composites of fullerene nanotubes and compositions thereof; U.S. Pat. No. 7,407,640, entitled Functionalized carbon nanotube-polymer composites and interactions with radiation; U.S. Pat. No. 7,390,767, entitled Method for producing a catalyst support and compositions thereof; U.S. Pat. No. 7,390,477, entitled Fullerene nanotube compositions; U.S. Pat. No. 7,361,369, entitled Implant with structure allowing injection of polymer for attaching implant to tissue; U.S. Pat. No. 7,357,906, entitled Method for fractionating single-wall carbon nanotubes; U.S. Pat. No. 7,354,563, entitled Method for purification of as-produced fullerene nanotubes; U.S. Pat. No. 7,324,215, entitled Non-destructive optical imaging system for enhanced lateral resolution; U.S. Pat. No. 7,323,136, entitled Containerless mixing of metals and polymers with fullerenes and nanofibers to produce reinforced advanced materials; U.S. Pat. No. 7,306,828, entitled Fabrication of reinforced composite material comprising carbon nanotubes, fullerenes, and vapor-grown carbon fibers for thermal barrier materials, structural ceramics, and multifunctional nanocomposite ceramics; U.S. Pat. No. 7,264,876, entitled Polymer-wrapped single wall carbon nanotubes; U.S. Pat. No. 7,262,266, entitled Copolymerization of polybenzazoles and other aromatic polymers with carbon nanotubes; U.S. Pat. No. 7,253,014, entitled Fabrication of light emitting film coated fullerenes and their application for in-vivo light emission;

U.S. Pat. No. 7,205,069, entitled Membrane comprising an array of single-wall carbon nanotubes; U.S. Pat. No. 7,204,970, entitled Single-wall carbon nanotubes from high pressure CO; U.S. Pat. No. 7,176,146, entitled Method of making a molecule-surface interface; U.S. Pat. No. 7,125,533, entitled Method for functionalizing carbon nanotubes utilizing peroxides; U.S. Pat. No. 7,115,864, entitled Method for purification of as-produced single-wall carbon nanotubes; U.S. Pat. No. 7,108,841, entitled Method for forming a patterned array of single-wall carbon nanotubes; U.S. Pat. No. 7,105,596, entitled Methods for producing composites of single-wall carbon nanotubes and compositions thereof; U.S. Pat. No. 7,097,820, entitled Continuous fiber of single-wall carbon nanotubes; U.S. Pat. No. 7,087,207, entitled Method for forming an array of single-wall carbon nanotubes in an electric field and compositions thereof; U.S. Pat. No. 7,071,406, entitled Array of single-wall carbon nanotubes; U.S. Pat. No. 7,067,098, entitled Method for forming an array of single-wall carbon nanotubes and compositions thereof; U.S. Pat. No. 7,052,666, entitled Method for cutting single-wall carbon nanotubes; U.S. Pat. No. 7,048,999, entitled Method for producing self-assembled objects comprising single-wall carbon nanotubes and compositions thereof; U.S. Pat. No. 7,048,903, entitled Macroscopically manipulable nanoscale devices made from nanotube assemblies; U.S. Pat. No. 7,041,620, entitled Method for producing a catalyst support and compositions thereof; U.S. Pat. No. 7,029,646, entitled Method for cutting single-wall carbon nanotubes through fluorination; U.S. Pat. No. 7,008,604, entitled Method for cutting nanotubes; U.S. Pat. No. 7,008,563, entitled Polymer-wrapped single wall carbon nanotubes; U.S. Pat. No. 6,995,841, entitled Pulsed-multiline excitation for color-blind fluorescence detection; U.S. Pat. No. 6,986,876, entitled Method for forming composites of sub-arrays of single-wall carbon nanotubes; U.S. Pat. No. 6,979,709, entitled Continuous fiber of single-wall carbon nanotubes; U.S. Pat. No. 6,949,237, entitled Method for growing single-wall carbon nanotubes utilizing seed molecules; U.S. Pat. No. 6,939,525, entitled Method of forming composite arrays of single-wall carbon nanotubes and compositions thereof; U.S. Pat. No. 6,936,306, entitled Chemical control over ceramic porosity using carboxylate-alumoxanes; U.S. Pat. No. 6,936,233, entitled Method for purification of as-produced single-wall carbon nanotubes; U.S. Pat. No. 6,875,475, entitled Methods for producing submicron metal line and island arrays; U.S. Pat. No. 6,824,755, entitled Method for producing a catalyst support and compositions thereof; U.S. Pat. No. 6,778,316, entitled Nanoparticle-based all-optical sensors; U.S. Pat. No. 6,761,870, entitled Gas-phase nucleation and growth of single-wall carbon nanotubes from high pressure CO; U.S. Pat. No. 6,756,026, entitled Method for growing continuous carbon fiber and compositions thereof; U.S. Pat. No. 6,756,025, entitled Method for growing single-wall carbon nanotubes utilizing seed molecules; U.S. Pat. No. 6,749,827, entitled Method for growing continuous fiber; U.S. Pat. No. 6,683,783, entitled Carbon fibers formed from single-wall carbon nanotubes; U.S. Pat. No. 6,428,762, entitled Powder synthesis and characterization of amorphous carbon nitride, a-C3N4; U.S. Pat. No. 6,369,183, entitled Methods and materials for fabrication of alumoxane polymers; U.S. Pat. No. 6,322,890, entitled Supra-molecular alkylalumoxanes; U.S. Pat. No. 6,124,373, entitled Bone replacement compound comprising poly(polypropylene fumarate); U.S. Pat. No. 6,018,390, entitled Integrated optics waveguide accelerometer with a proof mass adapted to exert force against the optical waveguide during acceleration; or U.S. Patent Application Publication Nos.: 20160163652, entitled COATED FULLERENES, COMPOSITES AND DIELECTRICS MADE THEREFROM; 20160153098, entitled SELF-IMPROVING ELECTROCATALYSTS FOR GAS EVOLUTION REACTIONS; 20160137875, entitled CONDUCTIVE POLYMER COATING COMPOSITION; 20160131637, entitled SUSPENDED NANO-ELECTRODES FOR ON-CHIP ELECTROPHYSIOLOGY; 20160068690, entitled CARBON NANOTUBE COATING COMPOSITION; 20160002673, entitled SOLAR STEAM PROCESSING OF BIOFUEL FEEDSTOCK AND SOLAR DISTILLATION OF BIOFUELS; 20150368539, entitled CARBONACEOUS NANOPARTICLES AS CONDUCTIVITY ENHANCEMENT ADDITIVES TO WATER-IN-OIL EMULSIONS, OIL-IN-WATER EMULSIONS AND OIL-BASED WELLBORE FLUIDS; 20150360956, entitled PRODUCTION OF GRAPHENE NANOPLATELETS BY OXIDATIVE ANHYDROUS ACIDIC MEDIA; 20150307357, entitled PRODUCTION OF GRAPHENE NANORIBBONS BY OXIDATIVE ANHYDROUS ACIDIC MEDIA; 20150298164, entitled CARBON NANOTUBE FILMS PROCESSED FROM STRONG ACID SOLUTIONS AND METHODS FOR PRODUCTION THEREOF; 20150280248, entitled GRAPHENE QUANTUM DOT-CARBON MATERIAL COMPOSITES AND THEIR USE AS ELECTROCATALYSTS; 20150216975, entitled NANOVECTOR BASED DRUG DELIVERY SYSTEM FOR OVERCOMING DRUG RESISTANCE; 20150162381, entitled ADDRESSABLE SIOX MEMORY ARRAY WITH INCORPORATED DIODES; 20150108391, entitled SYNTHESIS OF MAGNETIC CARBON NANORIBBONS AND MAGNETIC FUNCTIONALIZED CARBON NANORIBBONS; 20150023858, entitled REBAR HYBRID MATERIALS AND METHODS OF MAKING THE SAME; 20140367091, entitled WELLBORE FLUIDS INCORPORATING MAGNETIC CARBON NANORIBBONS AND MAGNETIC FUNCTIONALIZED CARBON NANORIBBONS AND METHODS OF USING THE SAME; 20140363669, entitled CARBON NANOTUBES FIBER HAVING LOW RESISTIVITY, HIGH MODULUS AND/OR HIGH THERMAL CONDUCTIVITY AND A METHOD OF PREPARING SUCH FIBERS BY SPINNING USING A FIBER SPIN-DOPE; 20140357534, entitled METHODS, APPARATUS, AND SENSORS FOR TRACING FRAC FLUIDS IN MINERAL FORMATIONS, PRODUCTION WATERS, AND THE ENVIRONMENT USING MAGNETIC PARTICLES; 20140313636, entitled GRAPHENE-CARBON NANOTUBE HYBRID MATERIALS AND USE AS ELECTRODES; 20140255291, entitled LIQUID CRYSTALS FROM SINGLE-WALLED CARBON NANOTUBE POLYELECTROLYTES AND THEIR USE FOR MAKING VARIOUS MATERIALS; 20140193711, entitled COMBINED ELECTROCHEMICAL AND CHEMICAL ETCHING PROCESSES FOR GENERATION OF POROUS SILICON PARTICULATES; 20140187651, entitled MULTI-HIERARCHICAL SELF-ASSEMBLY OF A COLLAGEN MIMETIC PEPTIDE; 20140178688, entitled BERNAL-STACKED GRAPHENE LAYERS AND METHODS OF MAKING THE SAME; 20140154269, entitled TARGETED NANOVECTORS AND THEIR USE FOR TREATMENT OF BRAIN TUMORS; 20140141224, entitled FABRICATION OF CARBON FOAMS THROUGH SOLUTION PROCESSING IN SUPERACIDS; 20140120453, entitled PATTERNED GRAPHITE OXIDE FILMS AND METHODS TO MAKE AND USE SAME; 20140120167, entitled MULTIFUNCTIONAL CHEMO- AND MECHANICAL THERAPEUTICS; 20140120081, entitled USE OF CARBON NANOMATERIALS WITH ANTIOXIDANT PROPERTIES TO TREAT OXIDATIVE STRESS; 20140103255, entitled ALIPHATIC AMINE BASED NANOCARBONS FOR THE ABSORPTION OF CARBON DIOXIDE; 20140097842, entitled ELECTRON SPIN RESONANCE FOR MEDICAL IMAGING; 20140094391, entitled BIO-NANO-CHIPS FOR ON-SITE DRUG SCREENING; 20140084219, entitled DOPED MULTIWALLED CARBON NANOTUBE FIBERS AND METHODS OF MAKING THE SAME; 20140081067, entitled SORPTION AND SEPARATION OF VARIOUS MATERIALS BY GRAPHENE OXIDES; 20140077138, entitled BORON NITRIDE-BASED FLUID COMPOSITIONS AND METHODS OF MAKING THE SAME; 20140048748, entitled GRAPHENE NANORIBBON COMPOSITES AND METHODS OF MAKING THE SAME; 20140014030, entitled METHODS FOR PRODUCTION OF SINGLE-CRYSTAL GRAPHENES; 20140011034, entitled GRAPHITE OXIDE COATED PARTICULATE MATERIAL AND USES THEREOF; 20130345099, entitled Nano-Encapsulated Triggered-Release Viscosity Breaker; 20130334104, entitled DISTILLING A CHEMICAL MIXTURE USING AN ELECTROMAGNETIC RADIATION-ABSORBING COMPLEX FOR HEATING; 20130319973, entitled LAYER-BY-LAYER REMOVAL OF GRAPHENE; 20130306463, entitled PURIFYING A FLUID USING A HEAT CARRIER COMPRISING AN ELECTROMAGNETIC RADIATION-ABSORBING COMPLEX; 20130299933, entitled PLASMON INDUCED HOT CARRIER DEVICE, METHOD FOR USING THE SAME, AND METHOD FOR MANUFACTURING THE SAME; 20130295580, entitled ORAL CANCER POINT OF CARE DIAGNOSTICS; 20130274136, entitled PROSTATE CANCER POINT OF CARE DIAGNOSTICS; 20130264121, entitled GRAPHENE-BASED MATERIAL FOR SHALE STABILIZATION AND METHOD OF USE; 20130190472, entitled POLYAMIDE COMPOSITES HAVING FLEXIBLE SPACERS; 20130168543, entitled ANALYZING THE TRANSPORT OF PLASMONIC PARTICLES THROUGH MINERAL FORMATIONS; 20130130933, entitled BIOMARKER SIGNATURES FOR WELLNESS TESTING; 20130108826, entitled PRODUCTION OF HIGHLY CONDUCTIVE CARBON NANOTUBE-POLYMER COMPOSITES; 20130095314, entitled IMMOBILIZED CARBON NANOTUBES ON VARIOUS SURFACES; 20130090511, entitled SYNTHESIS OF ULTRASMALL METAL OXIDE NANOPARTICLES; 20130069271, entitled DYNAMIC STRAIN HARDENING IN POLYMER NANOCOMPOSITES; 20130048339, entitled TRANSPARENT ELECTRODES BASED ON GRAPHENE AND GRID HYBRID STRUCTURES; 20130045420, entitled ANODE BATTERY MATERIALS AND METHODS OF MAKING THE SAME; 20130017453, entitled Conformal Coating On Nanostructured Electrode Materials For Three-Dimensional Applications; 20120302816, entitled THERAPEUTIC COMPOSITIONS AND METHODS FOR TARGETED DELIVERY OF ACTIVE AGENTS; 20120267893, entitled ELECTRICITY GENERATION USING ELECTROMAGNETIC RADIATION; 20120238021, entitled METHODS OF SYNTHESIZING THREE-DIMENSIONAL HETEROATOM-DOPED CARBON NANOTUBE MACRO MATERIALS AND COMPOSITIONS THEREOF; 20120231326, entitled STRUCTURED SILICON BATTERY ANODES; 20120213994, entitled X-RAY ABSORBING COMPOSITIONS AND METHODS OF MAKING THE SAME; 20120208008, entitled GRAPHENE-BASED THIN FILMS IN HEAT CIRCUITS AND METHODS OF MAKING THE SAME; 20120189492, entitled FULLERENE COMPOSITIONS AND METHODS FOR PHOTOCHEMICAL PURIFICATION; 20120156102, entitled WASTE REMEDIATION; 20120155841, entitled GENERATING A HEATED FLUID USING AN ELECTROMAGNETIC RADIATION-ABSORBING COMPLEX; 20120153621, entitled COOLING SYSTEMS AND HYBRID A/C SYSTEMS USING AN ELECTROMAGNETIC RADIATION-ABSORBING COMPLEX; 20120119162, entitled Coated Fullerenes, Compositions And Dielectrics Made Therefrom; 20120090816, entitled SYSTEMS AND METHODS FOR HEAT TRANSFER UTILIZING HEAT EXCHANGERS WITH CARBON NANOTUBES; 20120024153, entitled ALIPHATIC AMINE BASED NANOCARBONS FOR THE ABSORPTION OF CARBON DIOXIDE; 20110318248, entitled Methods for Solubilizing and Separating Large Fullerenes; 20110311427, entitled Strongly Bound Carbon Nanotube Arrays Directly Grown On Substrates And Methods For Production Thereof; 20110287462, entitled PROTEIN FRAGMENT COMPLEMENTATION ASSAY FOR THERMOPHILES; 20110274624, entitled CONTRAST AGENTS IN POROUS PARTICLES; 20110220839, entitled CONVERTING NANOPARTICLES IN OIL TO AQUEOUS SUSPENSIONS; 20110213288, entitled Device And Method For Transfecting Cells For Therapeutic Uses; 20110201764, entitled POLYMER/CARBON-NANOTUBE INTERPENETRATING NETWORKS AND PROCESS FOR MAKING SAME; 20110086781, entitled METHOD FOR FORMING COMPOSITES OF SUB-ARRAYS OF FULLERENE NANOTUBES; 20110079770, entitled Preparation of Thin Film Transistors (TFTs) or Radio Frequency Identification (RFID) Tags or Other Printable Electronics Using Ink-Jet Printer and Carbon Nanotube Inks; 20110065946, entitled FLUORINATED NANODIAMOND AS A PRECURSOR FOR SOLID SUBSTRATE SURFACE COATING USING WET CHEMISTRY; 20110032511, entitled SYSTEM AND METHOD TO MEASURE NANO-SCALE STRESS AND STRAIN IN MATERIALS; 20100317820, entitled Polyol Functionalized Water Soluble Carbon Nanostructures; 20100303913, entitled Method for Nanoencapsulation; 20100294976, entitled COMPOSITION FOR ENERGY GENERATOR, STORAGE, AND STRAIN SENSOR AND METHODS OF USE THEREOF; 20100289524, entitled Method for Fabrication of a Semiconductor Element and Structure Thereof; 20100287374, entitled Protecting Hardware Circuit Design by Secret Sharing; 20100284898, entitled BULK CUTTING OF CARBON NANOTUBES USING ELECTRON BEAM IRRADIATION; 20100284156, entitled VERTICALLY-STACKED ELECTRONIC DEVICES HAVING CONDUCTIVE CARBON FILMS; 20100283504, entitled METHOD FOR FABRICATION OF A SEMICONDUCTOR ELEMENT AND STRUCTURE THEREOF; 20100279128, entitled Single-Crystalline Metal Nanorings and Methods for Synthesis Thereof; 20100252824, entitled Hybrid Molecular Electronic Devices Containing Molecule-Functionalized Surfaces for Switching, Memory, and Sensor Applications and Methods for Fabricating Same; 20100222536, entitled Method for Functionalizating Carbon Naontubes Utilizing Peroxides; 20100222501, entitled SCALABLE PROCESS FOR SYNTHESIZING UNIFORMLY-SIZED COMPOSITE NANOPARTICLES; 20100209632, entitled Fluorescent Carbon Nanotube Compositions Deposited on Surfaces; 20100186665, entitled Method for low temperature growth of inorganic materials from solution using catalyzed growth and re-growth; 20100151248, entitled Fabrication of light emitting film coated fullerenes and their application for in-vivo emission; 20100143230, entitled METHOD FOR PREPARATION OF NEW SUPERHARD B—C—N MATERIAL AND MATERIAL MADE THEREFROM; 20100139946, entitled SELF-ASSEMBLED NANOPARTICLES-NANOTUBE STRUCTURES BASED ON ANTENNA CHEMISTRY OF CONDUCTIVE NANORODS; 20100133513, entitled NANOPARTICLE/NANOTUBE-BASED NANOELECTRONIC DEVICES AND CHEMICALLY-DIRECTED ASSEMBLY THEREOF; 20100120942, entitled SYNTHESIS OF METAL AND METAL OXIDE NANOPARTICLE-EMBEDDED SILOXANE COMPOSITES; 20100113696, entitled METHODS FOR PREPARING CARBON NANOTUBE/POLYMER COMPOSITES USING FREE RADICAL PRECURSORS; 20100108884, entitled Micromechanical Devices for Materials Characterization; 20100096265, entitled MACROSCOPICALLY MANIPULABLE NANOSCALE DEVICES MADE FROM NANOTUBE ASSEMBLIES; 20100040549, entitled Composition for Targeted Drug Delivery and Controlled Release; 20100035047, entitled METAL AND METAL OXIDE NANOPARTICLE-EMBEDDED COMPOSITES; 20100028680, entitled Nonconcentric nanoshells and methods of making and using same; 20100028247, entitled METHODS FOR SELECTIVE FUNCTIONALIZATION AND SEPARATION OF CARBON NANOTUBES; 20100021367, entitled FACILE PURIFICATION OF CARBON NANOTUBES WITH LIQUID BROMINE AT ROOM TEMPERATURE; 20100008843, entitled MULTI-STEP PURIFICATION OF SINGLE-WALL CARBON NANOTUBES; 20090294753, entitled CARBON NANOTUBE DIAMETER SELECTION BY PRETREATMENT OF METAL CATALYSTS ON SURFACES; 20090269593, entitled FUNCTIONALIZED, HYDROGEN-PASSIVATED SILICON SURFACES; 20090197315, entitled FULLERENE-BASED AMINO ACIDS; 20090173935, entitled PREPARATION OF THIN FILM TRANSISTORS (TFT's) OR RADIO FREQUENCY IDENTIFICATION (RFID) TAGS OR OTHER PRINTABLE ELECTRONICS USING INK-JET PRINTER AND CARBON NANOTUBE INKS; 20090169463, entitled ARRAY OF FULLERENE NANOTUBES; 20090124747, entitled CONDENSATION POLYMERS HAVING COVALENTLY BOUND CARBON NANOTUBES; 20090099276, entitled FUNCTIONALIZED CARBON NANOTUBE-POLYMER COMPOSITES AND INTERACTIONS WITH RADIATION; 20090027069, entitled FUNCTIONALIZED CARBON NANOTUBE-POLYMER COMPOSITES AND INTERACTIONS WITH RADIATION; 20090004094, entitled METHOD FOR CUTTING FULLERENE NANOTUBES; 20080311025, entitled METHOD FOR FORMING A PATTERNED ARRAY OF FULLERENE NANOTUBES; 20080260616, entitled Bulk Separation of Carbon Nanotubes by Bandgap; 20080224100, entitled METHODS FOR PRODUCING COMPOSITES OF FULLERENE NANOTUBES AND COMPOSITIONS THEREOF; 20080213162, entitled Amplification of Carbon Nanotubes Via Seeded-Growth Methods; 20080176212, entitled All optical nanoscale sensor; 20080171204, entitled Fabrication of light emitting film coated fullerenes and their application for in-vivo light emission; 20080169061, entitled INTERACTION OF MICROWAVES WITH CARBON NANOTUBES TO FACILITATE MODIFICATION; 20080107586, entitled METHOD FOR PRODUCING A CATALYST SUPPORT AND COMPOSITIONS THEREOF; 20080105648, entitled Carbon nanotube substrates and catalyzed hot stamp for polishing and patterning the substrates; 20080089830, entitled FULLERENE NANOTUBE COMPOSITIONS; 20080063588, entitled METHOD FOR PURIFICATION OF AS-PRODUCED FULLERENE NANOTUBES; 20080063585, entitled FULLERENE NANOTUBE COMPOSITIONS; 20080048364, entitled Polymer/Carbon-Nanotube Interpenetrating Networks and Process for Making Same; 20080014654, entitled Efficient fluorimetric analyzer for single-walled carbon nanotubes; 20070298669, entitled Sidewall Functionalization Of Carbon Nanotubes With Organosilanes For Polymer Composites; 20070297216, entitled SELF-ASSEMBLY OF MOLECULAR DEVICES; 20070280876, entitled Functionalization of Carbon Nanotubes in Acidic Media; 20070259994, entitled Elastomers Reinforced with Carbon Nanotubes; 20070249180, entitled METHOD OF MAKING A MOLECULE-SURFACE INTERFACE; 20070228317, entitled FABRICATION OF REINFORCED COMPOSITE MATERIAL COMPRISING CARBON NANOTUBES, FULLERENES, AND VAPOR-GROWN CARBON FIBERS FOR THERMAL BARRIER MATERIALS, STRUCTURAL CERAMICS, AND MULTIFUNCTIONAL NANOCOMPOSITE CERAMICS; 20070204790, entitled Solvents and new method for the synthesis of cdse semiconductor nanocrystals; 20070118937, entitled Copolymerization and copolymers of aromatic polymers with carbon nanotubes and products made therefrom; 20070110658, entitled Water-soluble single-wall carbon nanotubes as a platform technology for biomedical applications; 20070099792, entitled Carbon nanotube reinforced thermoplastic polymer composites achieved through benzoyl peroxide initiated interfacial bonding to polymer matrices; 20070098620, entitled Method for functionalizing carbon nanotubes utilizing peroxides; 20070071667, entitled Thermal treatment of functionalized carbon nanotubes in solution to effect their functionalization; 20070062411, entitled Fluorescent security ink using carbon nanotubes; 20070048209, entitled Continuous fiber of fullerene nanotubes; 20070043158, entitled Method for producing self-assembled objects comprising fullerene nanotubes and compositions thereof; 20070009421, entitled Fibers comprised of epitaxially grown single-wall carbon nanotubes, and a method for added catalyst and continuous growth at the tip; 20070009417, entitled Supported catalysts using nanoparticles as the support material; 20060269467, entitled Fluorinated nanodiamond as a precursor for solid substrate surface coating using wet chemistry; 20060253942, entitled Smart materials: strain sensing and stress determination by means of nanotube sensing systems, composites, and devices; 20060202168, entitled Functionalized carbon nanotube-polymer composites and interactions with radiation; 20060201880, entitled Length-based liquid-liquid extraction of carbon nanotubes using a phase transfer catalyst; 20060171874, entitled Sidewall functionalization of single-wall carbon nanotubes through C—N bond forming substitutions of fluoronanotubes; 20060166003, entitled Fabrication of carbon nanotube reinforced epoxy polymer composites using functionalized carbon nanotubes; 20060159921, entitled Method to fabricate inhomogeneous particles; 20060159612, entitled Ozonation of carbon nanotubes in fluorocarbons; 20060148272, entitled Fabrication of light emitting film coated fullerenes and their application for in-vivo light emission; 20060139634 Pulsed-multiline excitation for color-blind fluorescence detection; 20060135001, entitled Method for low temperature growth of inorganic materials from solution using catalyzed growth and regrowth; 20060051290, entitled Short carbon nanotubes as adsorption and retention agents; 20050260120, entitled Method for forming an array of single-wall carbon nanotubes in an electric field and compositions thereof; 20050249656, entitled METHOD FOR FORMING A PATTERNED ARRAY OF SINGLE-WALL CARBON NANOTUBES; 20050244326, entitled Method for fractionating single-wall carbon nanotubes; 20050171281, entitled Copolymerization of polybenzazoles and other aromatic polymers with carbon nanotubes; 20050158390, entitled Method to fabricate microcapsules from polymers and charged nanoparticles; 20050129726, entitled Pre-fabricated tissue-engineered plug; 20050089684, entitled Coated fullerenes, composites and dielectrics made therefrom; 20050018274, entitled Nanoparticle-based all-optical sensors; 20040265209, entitled Method for end-derivatizing single-wall carbon nanotubes and for introducing an endohedral group to single-wall carbon nanotubes; 20040223900, entitled Method for functionalizing carbon nanotubes utilizing peroxides; 20040222081, entitled Use of microwaves to crosslink carbon nanotubes; 20040222080, entitled Use of microwaves to crosslink carbon nanotubes to facilitate modification; 20040023479, entitled Method of making a molecule-surface interface; 20040009298, entitled Methods for producing submicron metal line and island arrays; 20030215638, entitled Reduced symmetry nanoparticles; 20030174384, entitled Nanoparticle-based all-optical sensors; 20030106998, entitled Method for producing boron nitride coatings and fibers and compositions thereof; 20030066960, entitled Apparatus for growing continuous single-wall carbon nanotube fiber; 20030010910, entitled Continuous fiber of single-wall carbon nanotubes; 20020159943, entitled Method for forming an array of single-wall carbon nanotubes and compositions thereof; 20020150524, entitled Methods for producing composites of single-wall carbon nanotubes and compositions thereof; 20020136683, entitled Method for forming composites of sub-arrays of single-wall carbon nanotubes; 20020136681, entitled Method for producing a catalyst support and compositions thereof; 20020127169, entitled Method for purification of as-produced single-wall carbon nanotubes; 20020127162, entitled Continuous fiber of single-wall carbon nanotubes; 20020109087, entitled Method for producing a catalyst support and compositions thereof; 20020109086, entitled Method for growing continuous carbon fiber and compositions thereof; 20020102201, entitled Method for forming an array of single-wall carbon nanotubes in an electric field and compositions thereof; 20020102196, entitled Compositions and articles of manufacture; 20020098135, entitled Array of single-wall carbon nanotubes; 20020096634, entitled Method for cutting single-wall carbon nanotubes; 20020094311, entitled Method for cutting nanotubes; 20020092984, entitled Method for purification of as-produced single-wall carbon nanotubes; 20020092983, entitled Method for growing single-wall carbon nanotubes utilizing seed molecules; 20020090331, entitled Method for growing continuous fiber; 20020090330, entitled Method for growing single-wall carbon nanotubes utilizing seed molecules; 20020088938, entitled Method for forming an array of single-wall carbon nanotubes and compositions thereof; 20020085968, entitled Method for producing self-assembled objects comprising single-wall carbon nanotubes and compositions thereof; and 20020084410, entitled Macroscopically manipulable nanoscale devices made from nanotube assemblies, the disclosures of which are incorporated herein in their entireties by reference thereto.

For example, electro-thermal nanotubes may be held in suspension within a urethane base. The electro-thermal nanotubes may be microscopic fibers of carbon that may conduct electricity, convert electricity into thermal energy, and are very durable. When energized, the nanotubes may act as resistive heating elements that heat up as electrical energy flows through, and may increase in temperature as the electrical energy increases, thereby, the nanotube coating may function as a radiant heat source. The electro-thermal nanotubes may work with either alternating current (AC) or direct current (DC) electrical sources and temperature control may be achieved using off the shelf technology. A nanotube/urethane composite may be used as a spray on thermal coating that may convert a surface, on to which the composite is sprayed, into a radiant heat source.

While composite heating elements including carbon nanotubes are described herein in conjunction with superheaters in steam applications, the composite heating elements may be incorporated into numerous applications (e.g., heating asphalt, heating concrete, heating airplane wings and fuselages, water heaters, air heating, heating batteries, heated food containers, heated drink containers, etc.). In fact, the composite heating elements of the present disclosure may generally be incorporated in any convection, conduction or radiant heating application.

Turning to FIG. 1, a pulverized coal firing supercritical or ultrasupercritical boiler 10 may include a furnace 12 with water-cooled enclosure walls 14 and a roof 16. Burners 18 may be arranged at boiler walls 14 to, for example, fire pulverized coal and produce a flame zone 20 into the furnace 12. From the flame zone 20 heat may be conducted by radiation 22 and by hot flue gases 24. Because the radiation heat may depend on fourth power of absolute temperature, heat conduction by radiation may dominate in regions having direct visibility to the high temperature flame zone 20. The upper portion of the furnace 12 may include a hanging superheater 26 (e.g., a radiant superheater or a convection superheater), in which steam may be superheated, to be finally conducted to, for example, a steam turbine (not shown) to generate power. Horizontal pass 28 immediately downstream of the furnace 12 comprises further hanging superheaters, such as finishing superheaters 30 (e.g., a radiant superheater or a convection superheater). Any given superheater 26, 30 may be similar to, for example, those illustrated in, and described in conjunction, with FIGS. 2-5.

A superheater 26 may include one or more substantially planar, in parallel connected superheating elements 32, each of which may include a first vertical pass 34, a first connection pass 36, a second vertical pass 38, a third vertical pass 40, a second connection pass 42 and a fourth vertical pass 44. The first connection pass 36 and the second connection pass 42 may be horizontal. Alternatively or additionally, first connection pass 36 and the second connection pass 42 may be of another form, for example, half-circles. Steam to be superheated in the superheater 26 may be conducted, usually, from a convection superheater (not shown), along a feed pipe 46 to an inlet header 48, which is arranged at the upper end of the first vertical pass 34. Correspondingly, heated steam may be conducted via an outlet header 50, arranged at the upper end of the fourth vertical pass 44, along a discharge pipe 52 to the next stage. The next stage may be a finishing superheater 30 or, if the superheater 26 is a finishing superheater, a steam turbine (not shown). Normally, the steam turbine may be a high pressure steam turbine, but when the superheater 26 is a reheater, the steam turbine may be an intermediate pressure steam turbine.

From the inlet header 48 of the superheater 26, the steam to be superheated may be distributed to multiple parallel steam tubes 54 running as U-tubes through the first vertical pass 34, the first connection pass 36 and the second vertical pass 38 to an intermediate header, a so-called first header 56, arranged at the upper end of the second vertical pass 38. From the first header 56, the steam flows via a connecting pipe 58 to a second header 60 arranged at the upper end of the third vertical pass 40. The connecting pipe 58 may include a water attemperator 62, by which it is possible to adjust the temperature of the steam to a desired level before it enters the third vertical pass 40. The superheating system may comprise further water attemperators 64 upstream or downstream of the radiant superheater 26. From the second header 60 of the radiant superheater 26, the steam is again distributed to multiple parallel steam tubes 66 running as U-tubes through the third vertical pass 40, the second connection pass 42 and the fourth vertical pass 44, to the outlet header 50.

The second connection pass 42 may be arranged above the first connection pass 36, so that the first connection pass 36 may shield the second connection pass 42 from radiation from the lower portion of the furnace 12. The first vertical pass 34 and the second vertical pass 38 may be correspondingly arranged to surround the fourth vertical pass 44 and the third vertical pass 40.

Figure 2:
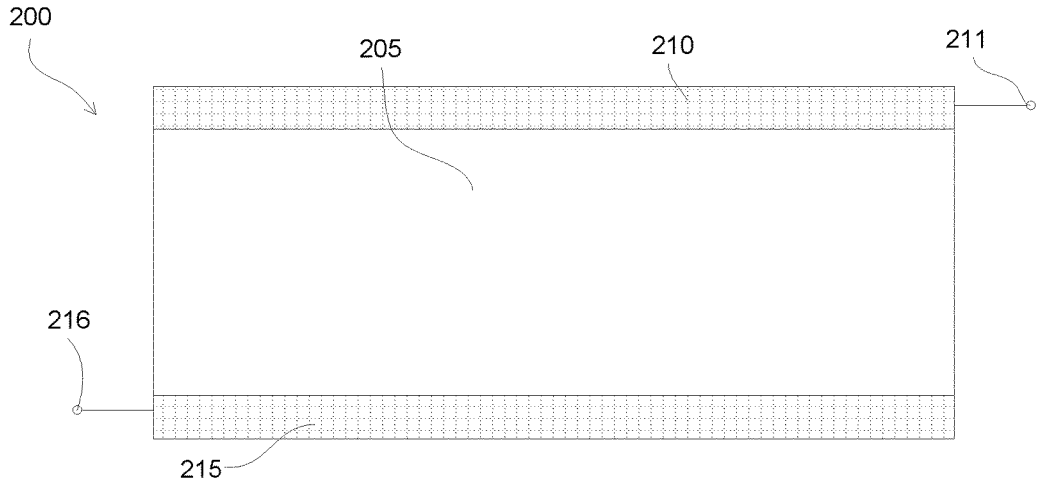
FIG. 2 depicts a plan view of an example nanoparticle composite heater.

With referenced to FIG. 2, a nanoparticle composite heating element 200 may include a nanoparticle composite 205 including a first electrode 210 having an activation connection 211, and a second electrode 215 having a negative connection 212. The nanoparticle composite 205 may include a nanometer-scale tube-like structure (e.g., BCN nanotube, ~BCN nanotube, ~BC2N nanotube, boron nitride nanotube, carbon nanotube, DNA nanotube, gallium nitride nanotube, silicon nanotube, inorganic nanotube, tungsten disulphide nanotube, membrane nanotube having a tubular membrane connection between cells, titania nanotubes, tungsten sulfide nanotubes, etc.). The nanoparticle heating element 200 may be similar to, for example, the nanoparticle composite heating elements 26, 30, 32 of FIG. 1.

Figure 3:
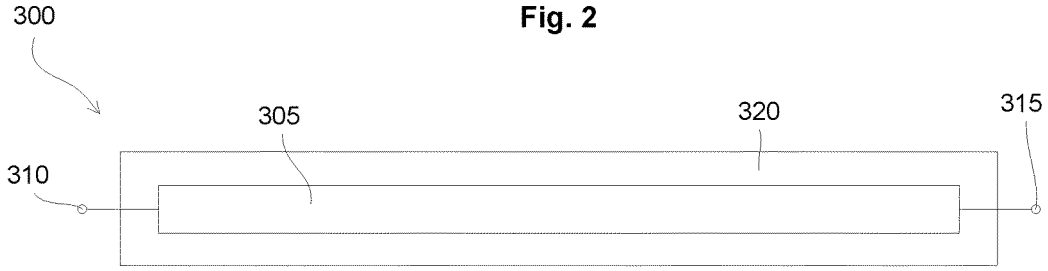
FIG. 3 depicts a profile view of an example nanoparticle composite heater encapsulated within an inert material.

Turning to FIG. 3, a heating element 300 may include a nanoparticle composite heater 305 encapsulated within an inert material 320 (e.g., glass, silicon, porcelain, etc). The nanoparticle heater 305 may be similar to, for example, the nanoparticle composite heating elements 26, 30, 32 of FIG. 1, or the nanoparticle composite heating element 200 of FIG. 2. The heating element 300 may also include an activation terminal 310 and a negative terminal 315.

Figure 4:
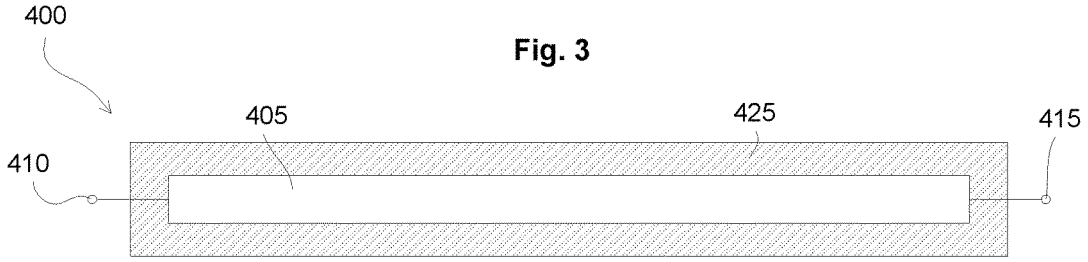
FIG. 4 depicts a profile view of an example nanoparticle composite heater encapsulated within a thermally conductive material.

With reference to FIG. 4, an element 400 may include a nanoparticle composite heater 405 encapsulated within a thermally conductive material 425 (e.g., metal, tin, copper, glass, silicon, porcelain, etc). The nanoparticle heater 405 may be similar to, for example, the nanoparticle composite heating elements 26, 30, 32 of FIG. 1, or the nanoparticle composite heating element 200 of FIG. 2, or the nanoparticle heater 300 of FIG. 3. The heating element 400 may also include an activation terminal 410 and a negative terminal 415.

Figure 5:
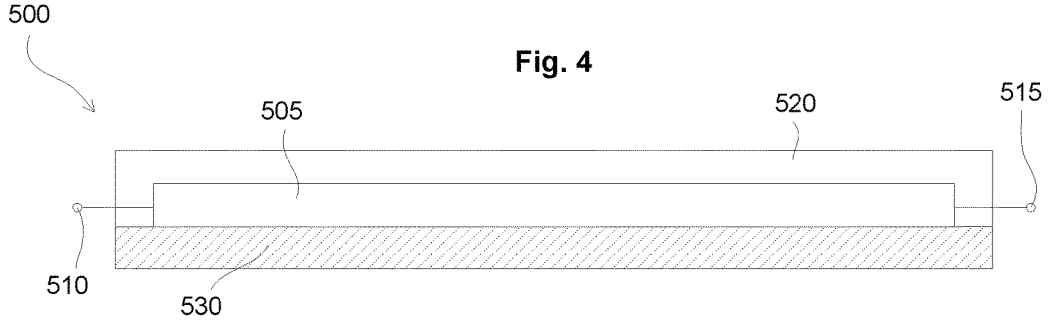
FIG. 5 depicts a profile view of an example nanoparticle composite heater encapsulated within an inert material and a thermally insulating material.

Turning to FIG. 5, an element 500 may include a nanoparticle composite heater 505 encapsulated within an inert material 520 and a thermally insulating material 530. The nanoparticle heater 505 may be similar to, for example, the nanoparticle composite heating elements 26, 30, 32 of FIG. 1, the nanoparticle composite heating element 200 of FIG. 2, the nanoparticle heater 300 of FIG. 3, or the nanoparticle heater 405 of FIG. 4. The heating element 500 may also include an activation terminal 510 and a negative terminal 515.

The thermally insulating material 530 may be fiberglass, mineral wool, cellulose, polyurethane foam, polystyrene, aerogel (used by NASA for the construction of heat resistant tiles, capable of withstanding heat up to approximately 2000 degrees Fahrenheit with little or no heat transfer), natural fibers (e.g., hemp, sheep's wool, cotton, straw, etc.), polyisocyanurate, or polyurethane.

A heating element 26, 30, 32, 200, 300, 400, 500 may include sidewall-functionalized carbon nanotubes. The functionalized carbon nanotubes may include hydroxyl-terminated moieties covalently attached to their sidewalls. Methods of forming the functionalized carbon nanotubes may involve chemistry on carbon nanotubes that have first been fluorinated. In some embodiments, fluorinated carbon nanotubes ("fluoronanotubes") may be reacted with mono-metal salts of a dialcohol, MO—R—OH. M may be a metal and R may be a hydrocarbon or other organic chain and/or ring structural unit. In such embodiments, —O—R—OH may displace —F on the associated nanotube, the fluorine may leave as MF. Generally, such mono-metal salts may be formed in situ by addition of MOH to one or more dialcohols in which the fluoronanotubes have been dispersed. Fluoronanotubes may be reacted with amino alcohols, such as being of the type H2N—R—OH, wherein —N(H)—R—OH displaces —F on the nanotube, the fluorine may leave as HF.

A heating element 26, 30, 32, 200, 300, 400, 500 may include carbon nanotubes integrated into an epoxy polymer composite via, for example, chemical functionalization of the carbon nanotubes. Integration of the carbon nanotubes into an epoxy polymer may be enhanced through dispersion and/or covalent bonding with an epoxy matrix during a curing process. In general, attachment of chemical moieties (i.e., functional groups) to a sidewall and/or end-cap of carbon nanotubes such that the chemical moieties may react with either epoxy precursor, a curing agent, or both during the curing process. Additionally, chemical moieties can function to facilitate dispersion of carbon nanotubes with an epoxy matrix by decreasing van der Waals attractive forces between the nanotubes.

A heating element 26, 30, 32, 200, 300, 400, 500 may include a carbon nanotube carpet that may include a resistance of a nanotube, and/or the nanotube carpet, of between about 0.1 kΩ and about 10.0 kΩ. Instead, the resistance of a nanotube may be between about 2.0 kΩ and about 8.0 kΩ. As an another alternative, the resistance of a nanotube may be between about 3.0 kΩ and about 7.0 kΩ. A conductive layer/contact may include single or dual damascene copper interconnects, poly-silicon interconnects, silicides, nitrides, and refractory metal interconnects such as, but not limited to, Al, Ti, Ta, Ru, W, Nb, Zr, Hf, Ir, La, Ni, Co, Au, Pt, Rh, Mo, and their combinations. An insulating material or materials may be coated onto individual tubes and/or bundles of tubes (nanotubes) to isolate the tubes and/or bundles from a conductive material. An insulating material may completely cover the tubes and/or bundles. Alternatively, gaps or other discontinuities may be included in the insulating material such that the nanotubes and/or bundles of nanotubes are not completely covered. The insulating material may include polymeric, oxide materials, and/or the like.

A heating element 26, 30, 32, 200, 300, 400, 500 may be at least partially formed on a liquid and/or gas heater tank and/or associated piping by spraying a carbon nanotube/epoxy solution onto a fabric as described herein and within the patents and patent applications that are incorporated herein by reference. The resulting heating element 26, 30, 32, 200, 300, 400, 500 may be on an outside of the tank and/or piping, an inside surface of the tank and/or piping, or may be sandwiched between two or more pieces of the tank and/or piping.

Although exemplary embodiments of the invention have been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A superheater, comprising:

a composite heating element that includes sidewall-functionalized carbon nanotubes, wherein the composite heating element is encapsulated within a thermally insulating material on a first surface of the heating element and an inert material on a second surface and sides of the heating element;

a positive electrical connection and a negative electrical connection, wherein the positive electrical connection and the negative electrical connection extend through the inert material, and wherein the positive electrical connection and the negative electrical connection are configured to connect the sidewall-functionalized carbon nanotubes to an electric power source.

2. The superheater of claim 1 arranged to hang at the upper portion of a furnace of a boiler, wherein the superheater is planar and comprises: a first vertical pass; a first connection pass; a second vertical pass; a third vertical pass; a second connection pass; and a fourth vertical pass, wherein each vertical pass comprises an upper end and a lower end, the vertical passes are connected in series, so that steam to be superheated enters at the upper end of the first vertical pass and flows through the first vertical pass and from the lower end of the first vertical pass via the first connection pass to the lower end of the second vertical pass and through the second vertical pass and from the upper end of the second vertical pass to the upper end of the third vertical pass and through the third vertical pass and from the lower end of the third vertical pass via the second connection pass to the lower end of the fourth vertical pass and through the fourth vertical pass, to be discharged from the upper end of the fourth vertical pass, and wherein the first connection pass is arranged below the second connection pass so as to shield the second connection pass from radiation from the lower portion of the furnace.

3. The superheater of claim 2, wherein the first vertical pass and the second vertical pass are arranged to surround the fourth vertical pass and the third vertical pass, so as to shield the fourth vertical pass and the third vertical pass from radiation.

4. The superheater of claim 2, wherein each of the first vertical pass, the first connection pass, the second vertical pass, the third vertical pass, the second connection pass and the fourth vertical pass comprises multiple parallel steam tubes.

5. The superheater of claim 4, wherein each of the multiple parallel steam tubes of the first vertical pass is in steam flow connection to one of the multiple parallel steam tubes of the first connection pass and each of the multiple parallel steam tubes of the first connection pass is in steam flow connection to one of the multiple parallel steam tubes of the second vertical pass.

6. The superheater of claim 5, wherein each of the multiple parallel steam tubes of the third vertical pass is in steam flow connection to one of the multiple parallel steam tubes of the second connection pass and each of the multiple parallel steam tubes of the second connection pass is in steam flow connection to one of the multiple parallel steam tubes of the fourth vertical pass.

7. A superheater, comprising:

a composite heating element that includes carbon nanotubes, wherein the composite heating element is encapsulated within a thermally insulating material on a first surface of the heating element and an inert material on a second surface and sides of the heating element;

a positive electrical connection and a negative electrical connection, wherein the positive electrical connection and the negative electrical connection extend through the inert material, and wherein the positive electrical connection and the negative electrical connection are configured to connect the carbon nanotubes to an electric power source.

8. The superheater of claim 7, further comprising:

each of the multiple parallel steam tubes of a second vertical pass in steam flow connection to one of multiple parallel steam tubes of a third connection pass, and each of the multiple parallel steam tubes of the third connection pass is in steam flow connection to one of the multiple parallel steam tubes of the third vertical pass.

9. The superheater of claim 7, configured within a furnace that comprises a roof, multiple parallel steam tubes of a first vertical pass are connected to a first header arranged above the roof, each of the multiple parallel steam tubes of a second vertical pass is connected to a second header arranged above the roof, and the first header is in steam flow connection with the second header by a connecting pipe arranged outside the roof.

10. The superheater of claim 7, further comprising:

a connecting pipe, wherein the connecting pipe comprises a water attemperator.

11. A superheater, comprising:

a heating element that includes carbon nanotubes, wherein the heating element is encapsulated within a thermally insulating material on a first surface of the heating element and an inert material on a second surface and sides of the heating element;

a positive electrical connection and a negative electrical connection, wherein the positive electrical connection and the negative electrical connection extend through the inert material, and wherein the positive electrical connection and the negative electrical connection are configured to connect the carbon nanotubes to an electric power source.

12. The superheater of claim 11, wherein the heating element is an intermediate superheater arranged in steam flow direction downstream of a high pressure steam turbine.

13. The superheater of claim 11, wherein the heating element is a finishing superheater arranged in steam flow direction downstream of a high pressure steam turbine.

14. The superheater according to claim 11, wherein the heating element defines a supercritical boiler.

15. The superheater according to claim 11, wherein the heating element defines an ultra supercritical boiler.

* * * * *